US005771535A

United States Patent [19]

Blessing

[11] Patent Number: 5,771,535

[45] Date of Patent: Jun. 30, 1998

[54] LAWN AND GARDEN HANDLE

[76] Inventor: Kenneth C. Blessing, 448 Thornehill Trail, Oxford, Mich. 48371

[21] Appl. No.: 774,949

[22] Filed: Dec. 27, 1996

[51] Int. Cl.[6] ..... A47B 95/02

[52] U.S. Cl. ..... 16/110 R; 16/111 R; 294/57; 15/144.1

[58] Field of Search ..... 16/110 R, 111 R, 16/115; 294/57; 15/144.1, 144.2, 144.3, 143.1

[56] References Cited

U.S. PATENT DOCUMENTS

| | | | |
|---|---|---|---|
| 845,592 | 2/1907 | Stewart | 294/57 |
| 2,710,571 | 6/1955 | Pfister | 294/57 |
| 2,763,506 | 9/1956 | Denker et al. | 294/57 |
| 2,818,291 | 12/1957 | Corns | 15/144.1 |
| 3,222,699 | 12/1965 | Zeisig | 294/57 |
| 3,773,375 | 11/1973 | Nehls | 15/144.3 |
| 4,038,719 | 8/1977 | Bennett . | |
| 4,183,528 | 1/1980 | An . | |
| 4,625,965 | 12/1986 | Mullins . | |
| 4,704,858 | 11/1987 | Hoffman . | |
| 4,809,388 | 3/1989 | Dietrich . | |
| 4,828,427 | 5/1989 | Nisenbaum . | |
| 4,962,561 | 10/1990 | Hamilton . | |
| 4,985,961 | 1/1991 | Kegley . | |
| 5,050,261 | 9/1991 | Hofacker | 15/144.1 |
| 5,060,343 | 10/1991 | Nisenbaum . | |
| 5,125,130 | 6/1992 | Stanish . | |
| 5,133,101 | 7/1992 | Hauser et al. . | |
| 5,159,769 | 11/1992 | Odorisio | 294/57 |
| 5,263,253 | 11/1993 | Sainsbury | 294/57 |

OTHER PUBLICATIONS

P. 21, After Therapy™ Catalog—NCM Consumer Products Division ©1994 North Coast Medical, Inc., San Jose, CA 95125.

*Primary Examiner*—Chuck Mah
*Attorney, Agent, or Firm*—Bliss McGlynn, P.C.

[57] ABSTRACT

A utility handle for use with a plurality of implements. The handle includes a shaft portion and a handle portion, the handle portion including a plurality of grip portions. The grip portions positioned such that the user may grasp the handle in a variety of comfortable and ergonomic positions to relieve stress and fatigue occurring during use.

20 Claims, 6 Drawing Sheets

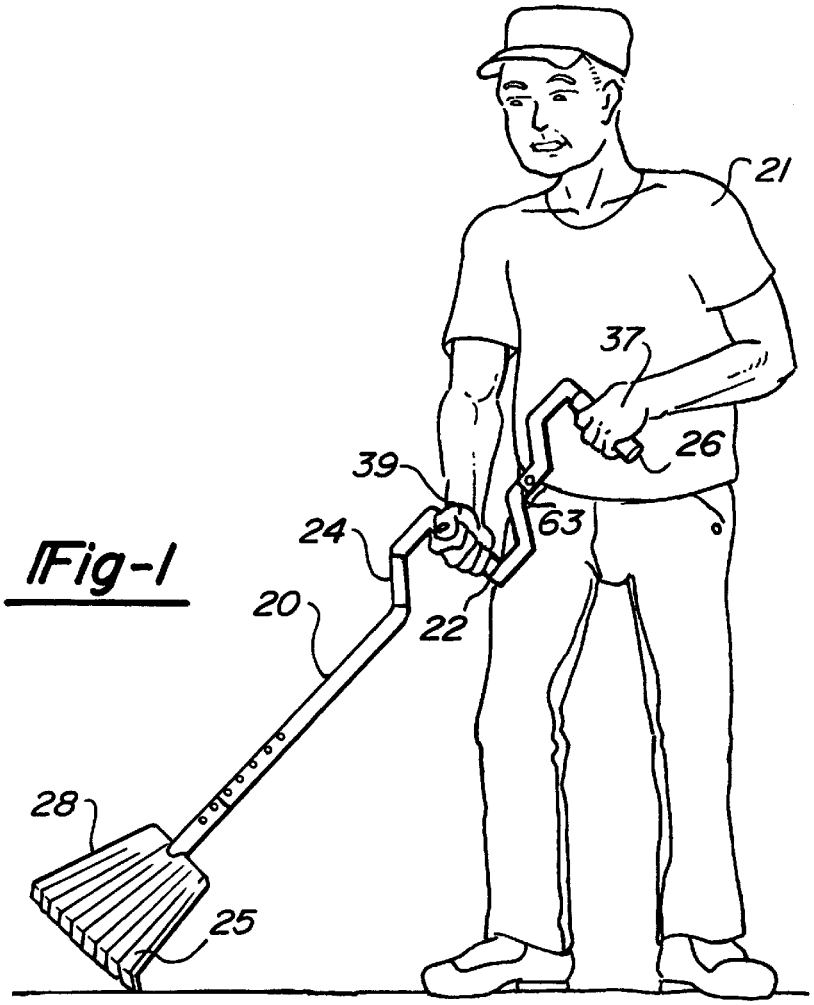
Fig-1
Fig-2a
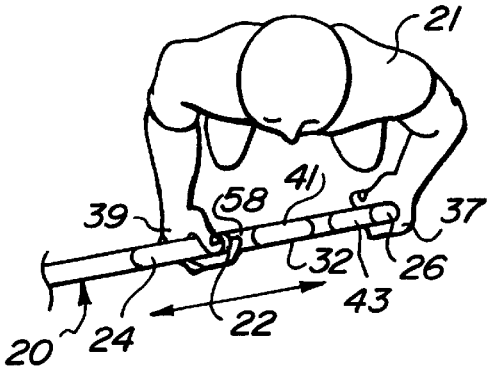
Fig-2b
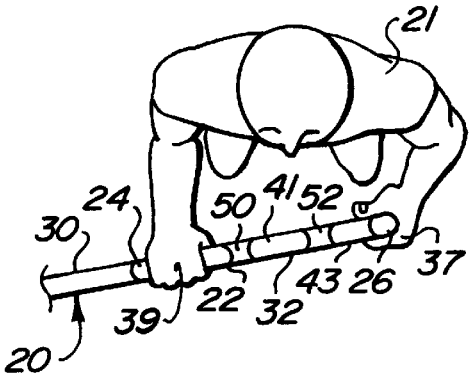

Fig-3
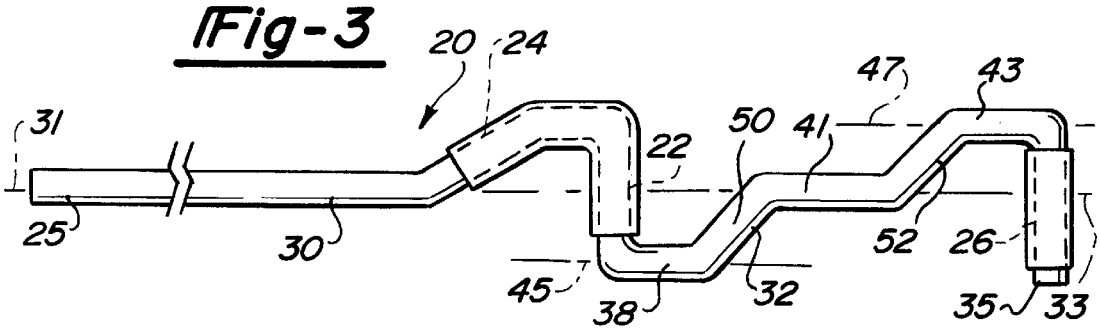
Fig-4a
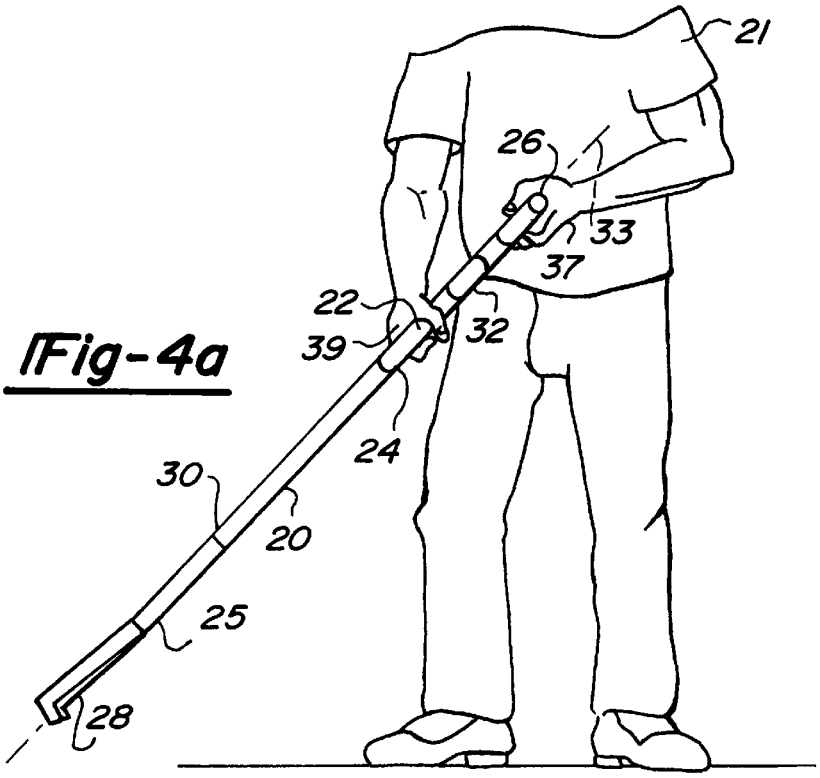
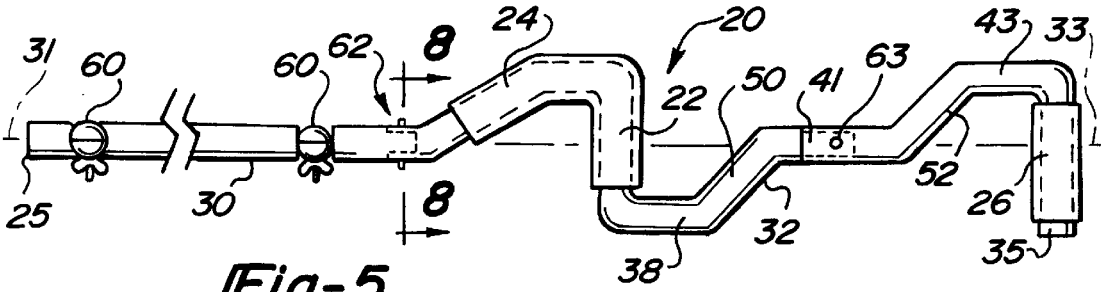
Fig-5

Fig-6
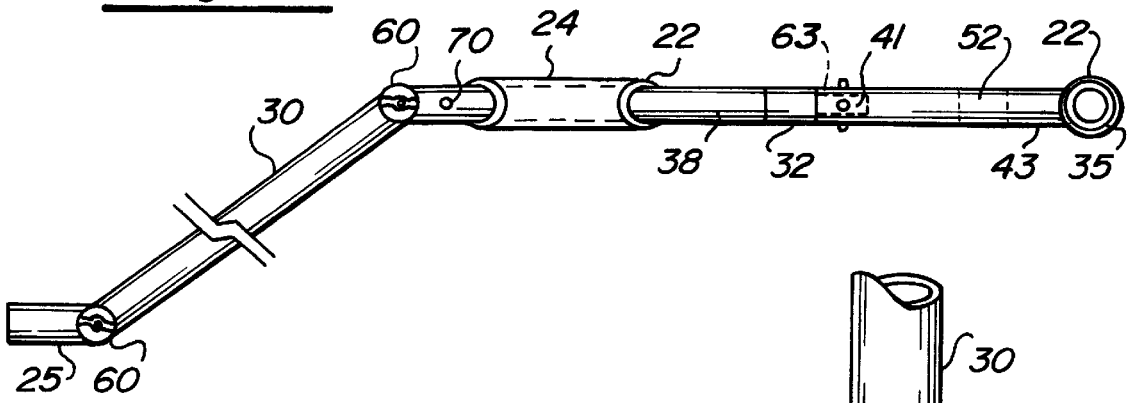
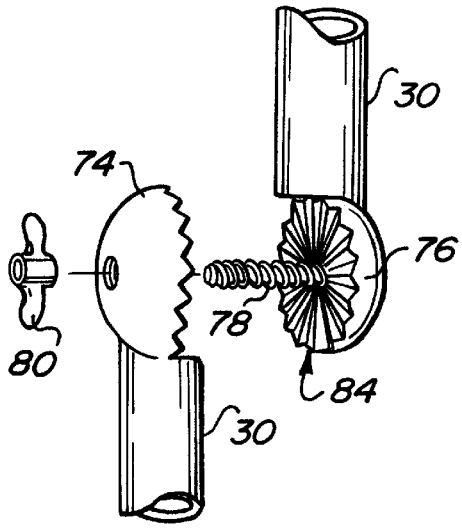
Fig-7b
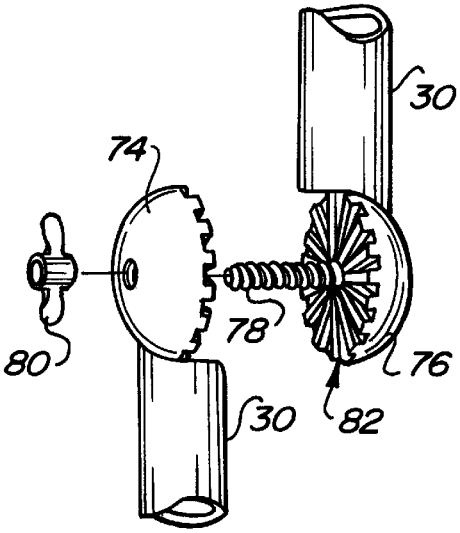
Fig-7a
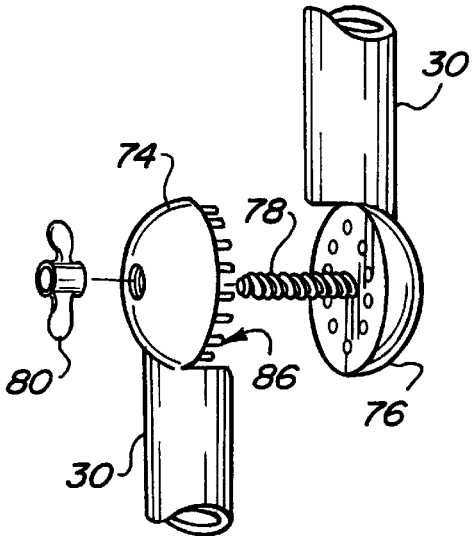
Fig-7c
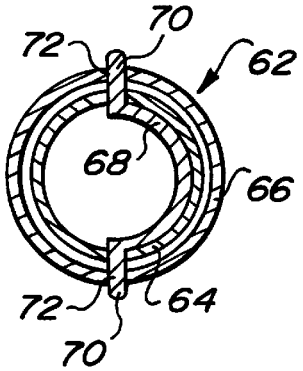
Fig-8

LAWN AND GARDEN HANDLE

BACKGROUND OF THE INVENTION

1. Field of the Invention

The present invention relates to a handle for use with an implement attached on one end thereof, and more particularly to an ergonomically-shaped handle for use with lawn and garden implements.

2 Description of the Related Art

Most lawn and garden implements use conventional, straight handles; i.e., an elongated, axial member. Straight handles waste energy. A user must exert a certain grip pressure on the handle to prevent the handle from sliding back and forth in the user's hands. If the handle is allowed to slide back and forth in the user's hands, friction, created at the hand/handle interface, causes blisters to form on the user's hands. To prevent blisters from occurring, the user must increase his or her grip pressure on the handle, resulting in greater stress on the joints and limbs. However, as increased force is applied to the implement, a greater force must be applied by the user to maintain proper contact with the handle and prevent movement of the user's hands along the handle. Thus, as the user's hands begin to tire, they begin to slide along the handle and damage to the user's hands starts to occur.

Various types of angled handles have been developed in an attempt to overcome these drawbacks. Angled handles try to take advantage of a user's body shape and position the arm, wrist, hand and torso in a more relaxed posture. However, these handles fail to take into account the different forces applied to the handle during use. The handle should be configured such that the user can grasp the handle and apply or transmit a force directly to the implement attached to the handle. Proper handle configuration prevents increased exertion by the user while allowing the user to grasp and maintain a secure hold on the handle.

SUMMARY OF THE INVENTION

Accordingly, the present invention is a handle having a unique configuration. The handle includes a plurality of hand holds or grip portions that transfer the force generated by the user to an implement attached to the handle. In general, the handle includes two portions; an elongated shaft portion and a handle portion. The handle portion includes at least one hand hold or grip portion positioned perpendicular or at a slight angle to a longitudinal axis or center line of the shaft portion.

In the preferred embodiment, the handle section includes three grip portions. Two of the grip portions extend perpendicular to the longitudinal axis of the shaft portion. The third grip portion extends outward at an angle from the longitudinal axis of the shaft portion. The third grip portion allows the user to position one hand at an angle to the longitudinal axis of the shaft portion while the other hand is positioned perpendicular to the longitudinal axis of the shaft portion. Grasping the handle in this position; i.e., placing the user's hands where indicated, enables the user to transmit increased energy to the implement while minimizing nonproductive or wasted energy in the form of friction or gripping force.

The handle may also include a straight portion or section forming an additional grip portion that coincides with or is parallel to the longitudinal axis of the shaft portion. Such a configuration provides a versatile handle for use with an assortment of different implements. Varying the position of the user's hands on the handle relative to the particular implement used helps to reduce the back and forth motion occurring during use and correspondingly reduces user fatigue and injury.

A further embodiment includes an adjustable pivot joint in the shaft portion. The pivot joint allows the shaft portion to be twisted, turned and repositioned to further conform the handle/implement combination to the configuration of the user rather than conforming the user to the handle/implement combination.

A handle according to the present invention reduces user fatigue and increases the force transferred through the handle to the implement. It should be appreciated that the handle distributes the forces occurring during use on the flats of the palm and fingers and directly to the muscles in the arm as opposed to the wrist and gripping muscles. The handle design reduces stress while applying more force to the implement. Finally, the handle configuration may take various shapes while still achieving the objects and goals of the invention as will be apparent from a review of the drawings and the detailed specification.

BRIEF DESCRIPTION OF THE DRAWINGS

FIG. 1 is a perspective view of a handle according to the present invention shown in use with a rake implement attached thereto.

FIG. 2*a* is a top view of the handle of FIG. 1.

FIG. 2*b* is a top view of the handle of FIG. 1 with the user's front hand positioned on a front grip portion.

FIG. 3 is a side view of a handle of FIG. 1.

FIG. 4*a* is a perspective view of the handle of FIG. 1 rotated 90 degrees and used with a shovel implement attached thereto.

FIG. 5 is a top view of the handle of FIG. 1 including a plurality of pivot joints and a handle adjustment feature.

FIG. 6 is a side view of the embodiment of FIG. 5.

FIGS. 7*a*–7*c* illustrates several embodiments of a pivot joint used in connection with the utility handle of FIG. 5.

FIG. 8 illustrates a locking assembly to prevent rotation of the handle about its longitudinal axis.

DETAILED DESCRIPTION OF THE PREFERRED EMBODIMENT(S)

Figure 4B:
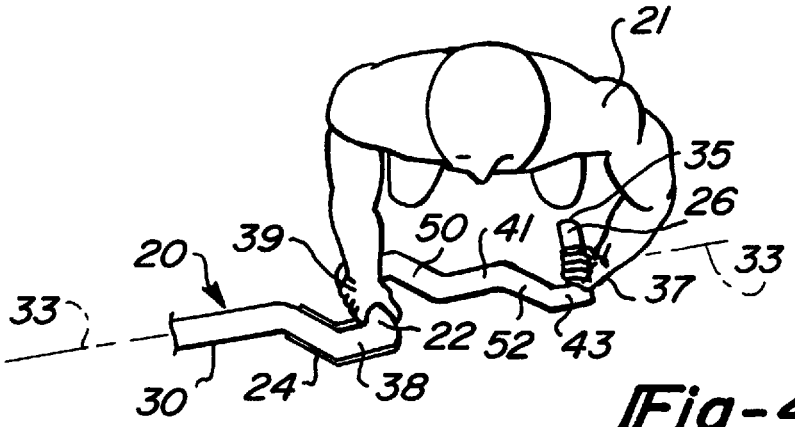
FIG. 4*b* is a partial top view of the handle of FIG. 4*a*.

Turning now to the drawings, and more particularly to FIGS. 1–4*b*, a handle 20, according to one embodiment of the present invention, is shown. The handle 20 is typically used with an implement 28 attached to an implement end 25 of the handle 20. As shown in the figures, a variety of implements 28 may be attached to the handle 20 for use in performing various tasks. For instance, in FIG. 1, the handle 20 is shown in one position with a rake implement. In FIG. 4*a,* the handle is shown rotated 90 degrees from its position in FIG. 1 and used with a shovel.

Turning to FIG. 3, specific portions of the handle 20 will now be set forth in further detail. The handle 20 is a contiguous, one-piece member starting at an implement end 25 and terminating at an upper end 35. The handle 20 includes a shaft portion 30 and a handle portion 32. The handle portion 32 has a first longitudinal axis 33. The shaft portion 30 is an elongated axial member having a second longitudinal axis or center line 31. As shown in FIG. 3, the first longitudinal axis 33 is coincident with the second longitudinal axis 31. However, as shown in FIG. 6, the respective axes may extend at an angle to one another. While disclosed herein as a tubular member, the handle 20 may be made with a variety of shapes and cross-sections, such as square or rectangular, or any shape having a resistance to torque or bending stress.

The handle portion 32 includes, as previously set forth, a plurality of grip portions 22, 24, 26. Viewing the grip portions 22, 24, 26 separately, the rearward grip portion 26 is disposed at the upper end 35 of the handle 20 and the front grip portion 24 is closest to the shaft portion 30. The middle grip portion 22 is positioned between the rear grip portion 26 and the front grip portion 24. As illustrated in FIG. 3, the handle portion 32 is positioned generally along the first longitudinal axis 33. The rear grip portion 26 extends transverse the first longitudinal axis 33. The rear grip portion 26 also lies in the same reference plane as the first longitudinal axis 33, the shaft portion 30 and the middle grip portion 22. When used as shown in FIG. 4*a,* the user 21 grasps the rear grip portion 26 with his left hand 37 and, moving forward along the handle portion 32 toward the implement end, positions his right hand 39 at the middle grip portion 22.

Turning to FIG. 2*b,* when using the handle 20 in connection with a rake implement 28, such as shown in FIG. 1, the user can rotate the handle 20 such that the hand grip portions 22, 26 are substantially vertical. See particularly FIGS. 2*a*–2*b* wherein the user 21 has an ergonomical handle 20 designed to directly apply pulling power to the implement 28 without having to increase the grip force of the user. FIG. 2*b* illustrates a user 21 having his right hand 39 placed on the front grip portion 24. Use of the front grip portion 24 allows the user 21 to apply a downward force on the handle 20, while the force exerted by the user's 21 left hand 37 on the rear grip portion 26 to move the handle remains in line with the first longitudinal axis 33. The user's left hand 37 remains perpendicular to the first longitudinal axis 33 and thus there is no back and forth motion of the left hand 37 along the rear grip portion 26. Turning to FIG. 4*a,* the handle 20 is shown in use with a shovel. The handle 20 is rotated 90 degrees such that the transverse axis of the middle and rear grip portions 22, 26 are substantially horizontal. Thus, a single handle 20 can be repositioned and used with several implements 28.

Returning to FIG. 3, the handle 20 is shown to include additional sections or portions. A connecting portion 41 is positioned between the respective middle and rear grip portions 22, 26. The connecting portion 41 has a longitudinal axis substantially parallel to or coinciding with the first longitudinal axis 33. The handle 20 further includes a pair of offset portions 38, 43 each having a longitudinal axis 45, 47 parallel to that of the shaft portion 30. The offset portions 43, 38 are joined through angled or skewed portions 50, 52 to the connecting portion 41. It should be appreciated that use of the various grip portions 22, 24, 26 enables the user 21 to vary his or her hand positions on the handle 20 in the most ergonomical fashion.

Turning now to FIGS. 5–6, an alternate embodiment of the present invention is shown. Parts common to those of FIG. 1 are given the same numerals and further explanation thereof is omitted. As shown in FIG. 5, the handle 20 includes a rotational connection 62 (see FIG. 8) which allows the shaft portion 30 to be rotated about an angle of 360 degrees depending upon a plurality of discreet adjustment points. As shown in FIG. 8, rotation of the shaft portion 30 with respect to the handle portion 32 is accomplished by providing an inner tube 64 on the shaft portion 30 and outer tube 66 on the handle portion 32. The inner tube 64 is disposed in and rotates within the outer tube 66 of the handle portion 32. A detent mechanism 68 includes pins 70 extending outward through ports 72 in the handle 32 and shaft portion 30. The rotational connection 62 enables the shaft portion 30 to be rotated and locked in any one of a number of discreet positions.

Turning to FIG. 6, the handle 20 may also include an additional rotational connection 63 disposed in the connecting portion 41. As used, the rotational connection 63 may be similar to rotational connection 62. It should be appreciated that rotational connection 63 provides additional versatility in that the rear grip portion 26 may be rotated about an angle of 360 degrees independently of the front 24 and middle 22 grip portions. Also, the connecting portion 41 may extend telescopically to increase the axial distance between the rear grip portion 26 and the middle grip portion 22.

The handle 20 also includes a plurality of pivot joints 60 allowing the implement end 25 of the shaft portion 30 to be positioned in a variety of positions. As shown in FIG. 6, the implement end 25 may be disposed below and still parallel to the longitudinal axis 33 of the handle 20 as shown in FIG. 5. The pivot joints 60 are shown in greater detail in FIGS. 7*a*–7*c*. The pivot joints 60 are formed of two complementary surfaces 74, 76 each attached to respective ends of the shaft portion 30. The complementary surfaces 74, 76 are interconnected with a threaded fastener 78 and wing nut 80. Tightening the wing nut 80 on the fastener 78 causes the two complementary surfaces 74, 76 to come together and mate in a fixed position whereby the shaft portion 30 can be secured in a variety of angular positions. FIG. 7*a* shows a square-toothed complementary surface 82; FIG. 7*b* shows a v-toothed complementary surface 84; and FIG. 7*c* shows a pin and corresponding socket assembly 86.

Figure 9A:
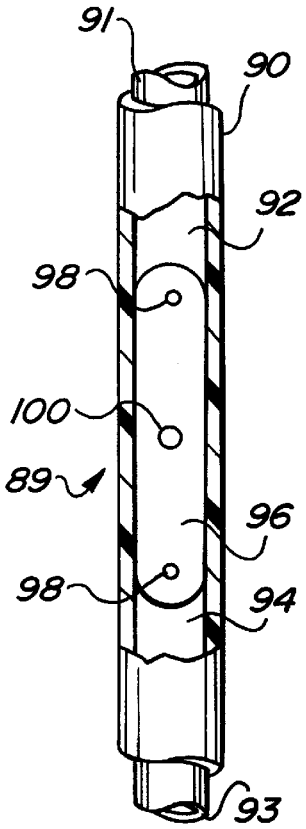
FIGS. 9*a*–9*b* illustrate a means for folding the handle.
Figure 9B:
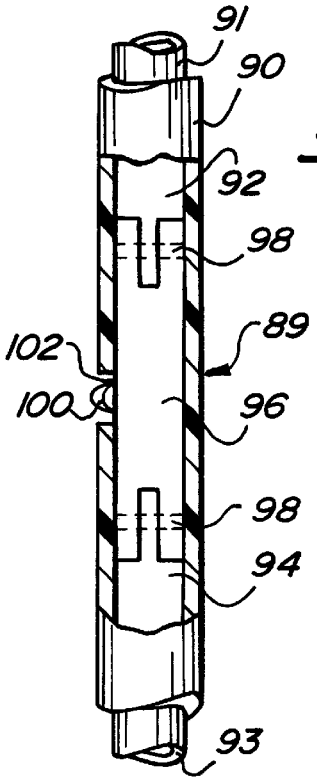

Turning now to FIGS. 9*a*–9*b,* a device 89 for folding the handle 20 into a compact package to reduce its storage size is shown. The shaft portion may be divided into sections 91, 93, and respective ends 92, 94 of the sections 91, 93 are coupled to a pivotal connection or link 96 via pins 98. Both sections 91, 93 may be folded about the link 96. When the handle 20 is unfolded, the collar 90 is placed over the link 96 to lock the sections in place and prevent pivoting. The collar 90 is locked by a detent mechanism 100, preferably a spring loaded plunger, that engages an opening 102 on the collar 90 to hold the collar 90 in place. To fold the handle 20, the detent pin 100 is depressed and the collar 90 is slid or moved to one side of the link 96 to expose the link 96 and enabling the respective sections 91, 93 to be folded to adjacent positions.

Figure 10A:
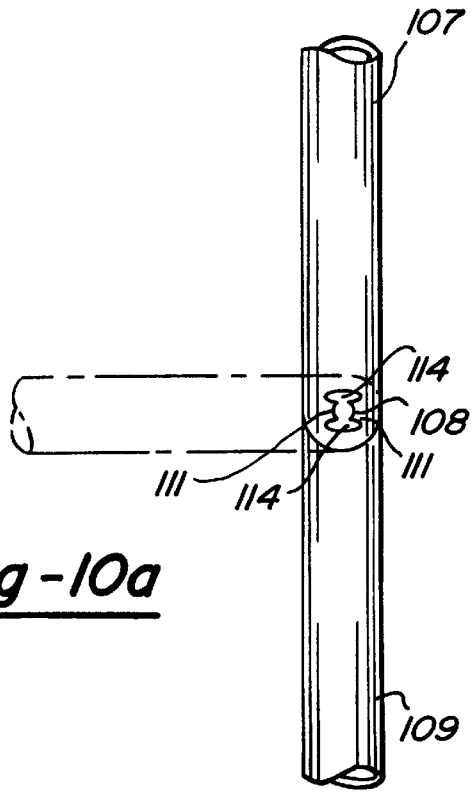
FIGS. 10*a*–10*b* illustrate a second embodiment of a means for folding the handle.
Figure 10B:
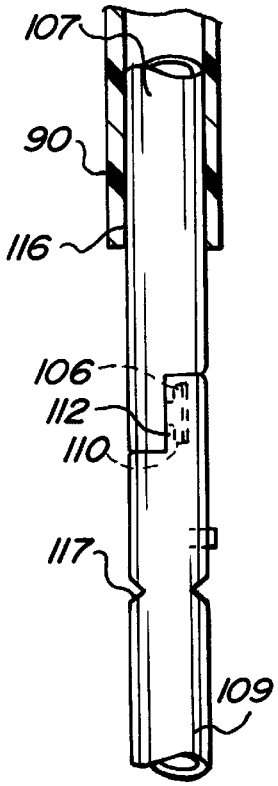

An additional means to fold the assembly is shown in FIGS. 10*a*–10*b*. As shown, a male locking nut or projection 106 and a female engagement opening 108 are respectively positioned on opposite sides of discreet sections 107, 109 of the shaft portion 30. The male locking projection 106 includes lugs 110 spaced from and forming a gap 112 with the shaft portion 30. The lugs 110 correspond to shaped openings 114 on the female engagement opening 108. The two may be slip-fit such that the openings 114 are placed over the lugs 110 at a 90 degree angle. When rotated 90 degrees, the lugs 110 engage the flat surfaces 111 of the handle to provide positive engagement. Similar to the previous embodiment, a collar 90 having a detent prong 116 is slid over the connection and engages a detent slot 117 to lock the handle 20 in the expanded or open position.

Figure 11:
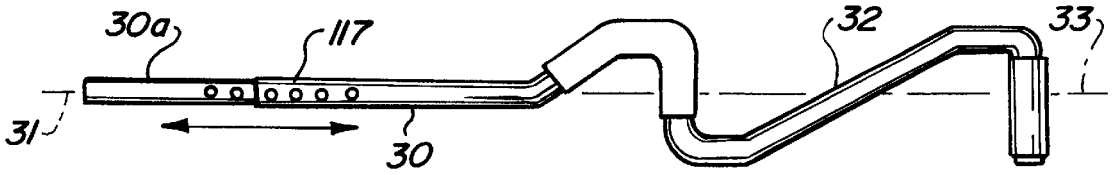
FIG. 11 is a first alternative embodiment of the handle of FIG. 1 including a telescopic shaft shown in plan view.

Turning now to FIG. 11, an additional embodiment of a handle 20 is shown. The handle 20 includes a telescopic or telescoping shaft portion 30*a* which allows the user to extend the overall length of the shaft portion 30. A suitable means for locking the telescopic shaft portion 30 in place, such as spring loaded detent pins 117, may be used. Pivot joints, as shown in FIGS. 7*a*–7*c*, may also be added to allow the implement 28 to be moved to any of several angular positions.

Figure 12:
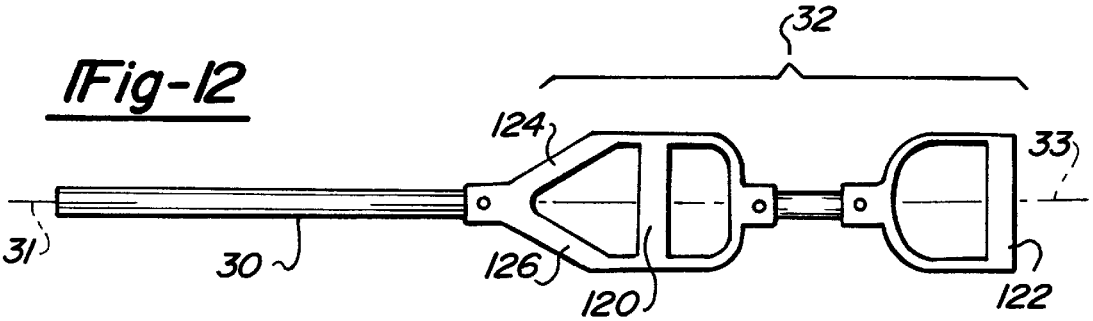
FIG. 12 is a second alternative embodiment of a handle according to the present invention shown in plan view.

Turning now to FIG. 12, another alternative embodiment of the handle 20 is shown. As shown, the handle 20 includes two grip portions 120, 122 extending substantially perpendicular or transverse the first longitudinal axis 33. The handle 20 also includes two oblique grip portions 124, 126 extending outward with respect to the first longitudinal axis 33. The embodiment further illustrates the various configurations the handle 20 may take to provide the user 21 with a plurality of hand grip positions.

Figure 13:
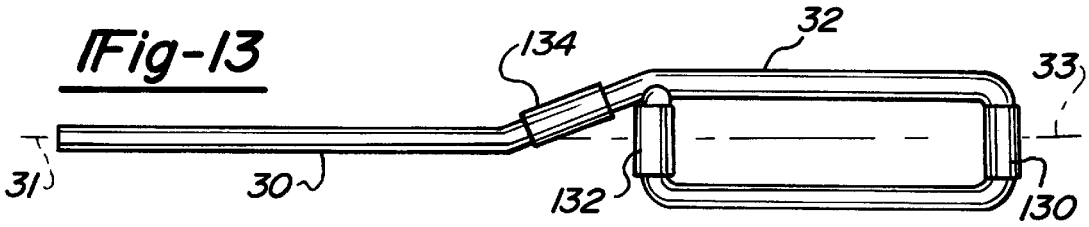
FIG. 13 is a third alternative embodiment of a handle according to the present invention shown in a plan view.

FIG. 13 shows a further embodiment of a handle 20 as a unitary tubular member piece formed to include at least two hand grip portions 130, 132 perpendicular to the first longitudinal axis 33. The handle 20 further includes at least one hand grip portion 134 disposed at an angle with respect to the first longitudinal axis 33.

Figure 14:
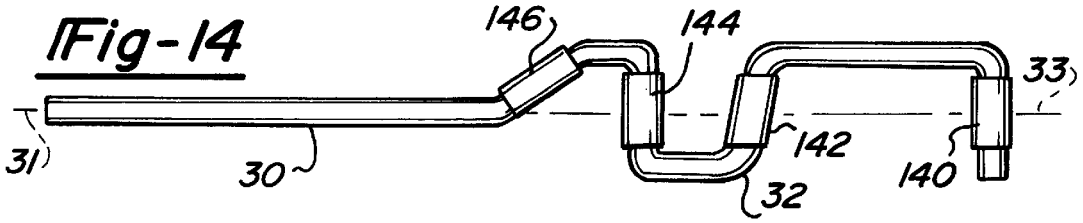
FIG. 14 is a fourth alternative embodiment of a handle according to the present invention shown in plan view.

FIG. 14 is a further embodiment showing a handle 20 having four grip portions 140, 142, 144, 146. Three of the grip portions 140, 142, 144 are positioned substantially transverse the first longitudinal axis 33 and the fourth grip portion 146 is angled or skewed with respect to the first longitudinal axis 33.

Figure 15:
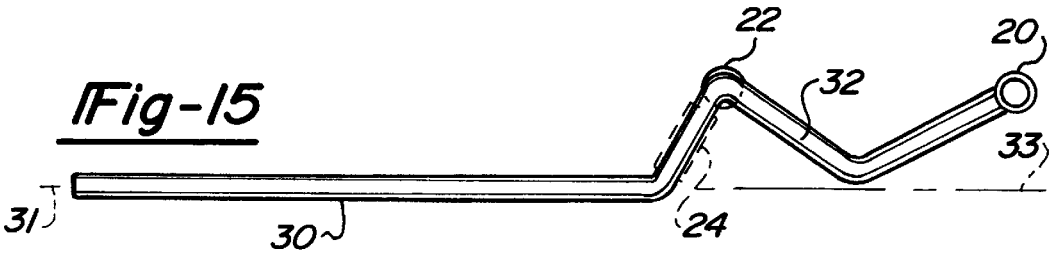
FIG. 15 is a fifth alternative embodiment of a handle according to the present invention shown in plan view.

Turning now to FIG. 15, the utility handle 20 of FIG. 15 is similar to that of FIG. 11 except that the middle and rear grip portions 22, 26 and front grip portion 24 are spaced from a single reference plane defined by the first longitudinal axis 33. If, for example, the first longitudinal axis 33 lies in a plane extending perpendicular to the drawing; i.e., FIG. 11 illustrates a side view, then the handle portion 32 extends above and is positioned outside of the plane.

Thus, the disclosed ergonomic handle 20 for lawn, garden and home use provides a superior alternative to straight or slightly angled handles. The handle 20 of the present invention positions the user's 21 hands in a more vertical, horizontal or angular fashion to said handle while maintaining a comfortable hand position. When using a handle 20 according to the present invention, the cup or palm of the hand is in a more perpendicular direction to the center line of the forearm which allows a more natural position of the body; i.e., the wrist. Further, the handle reduces blisters caused by a sliding back and forth motion on the palm which occurs with straight or slightly angled conventional handles.

Finally, the handle of the above invention evenly distributes the forces onto the flats and forefingers of the hands, thus transferring it easily to the arm muscles to reduce stress on the wrists. Furthermore, the handle 20 requires less work to operate the implement 28 attached to the shaft portion 30. It should be appreciated that various modifications, changes and other substitutions may be made while remaining within the scope of the instant invention.

What is claimed is:

1. A handle comprising:

a contiguous, one-piece member having first and second ends, said first end being an implement end; said one-piece member having a handle portion and a shaft portion, said shaft portion terminating at said first end and said handle portion terminating at said second end, said handle portion extending axially along a first longitudinal axis, said shaft portion having a second longitudinal axis, said handle portion including a plurality of grip portions, said grip portions oriented such that at least one of said grip portions is positioned transverse the first longitudinal axis and one of said grip portions is positioned such that it extends oblique said first longitudinal axis and slopes outwardly from said first longitudinal axis toward said second end.

2. A handle as set forth in claim 1 wherein said second longitudinal axis lies in a defined reference plane and said plurality of grip portions also lie in the same reference plane.

3. A handle comprising:

a contiguous, one-piece member having first and second ends, said first end being an implement end; said one-piece member having a handle portion and a shaft portion, said shaft portion terminating at said first end and said handle portion terminating at said second end, said handle portion extending axially along a first longitudinal axis said shaft portion having a second longitudinal axis, said handle portion including a plurality of grip portions, said grip portions oriented such that at least one of said grip portions is positioned transverse the first longitudinal axis and one of said grip portions is positioned such that it extends oblique said first longitudinal axis: wherein said plurality of grip portions include a rear grip portion, a front grip portion and a middle grip portion, said front grip portion positioned oblique the first longitudinal axis and said middle and rear grip portions positioned transverse the first longitudinal axis.

4. A handle as set forth in claim 3 wherein said front grip portion, said middle grip portion and said rear grip portion all lie in a common reference plane along with said shaft portion.

5. A handle as set forth in claim 3 wherein said front grip portion, middle grip portion and shaft portion all lie in a common reference plane and said rear grip portion extends transverse said common reference plane.

6. A handle as set forth in claim 3 including a connecting portion extending between said middle grip portion and said rear grip portion.

7. A handle as set forth in claim 6 including a connector positioned in said connecting portion, said connector interconnecting said middle grip portion with said rear grip portion such that said rear grip portion may be adjusted about the first longitudinal axis.

8. A handle as set forth in claim 3 wherein said shaft portion includes a pivot joint.

9. A handle as set forth in claim 3 wherein said handle includes a means for folding said handle to decrease the overall length of said handle.

10. A handle as set forth in claim 9 wherein said means includes a link member pivotally connected to respective shaft sections of said shaft portion, a collar slidably positioned over said link member, said collar operative when positioned over said link member to prevent said shaft sections from pivoting on said link member; a detent on said shaft portion and cooperating with said collar to retain said collar over said link member.

11. A handle as set forth in claim 9 wherein said means includes said shaft portion being formed of two discreet sections, one of said sections having a lug located thereon, said other section having a shaped opening therein, said lug combining with said shaped opening to join the respective shaft sections; and a collar slidably disposed over said shaft sections such that said collar extends over said lug and shaped opening combination to lock said shaft sections in an elongated position; and a detent on said one of said shaft sections, said detent cooperating with said collar to secure said collar in a locking position.

12. A handle as set forth in claim 1 wherein said plurality of grip portions includes at least two grip portions extending transverse the first longitudinal axis and one grip portion extending oblique the first longitudinal axis.

13. A handle as set forth in claim 1 wherein said plurality of grip portions includes four grip portions, three of said four grip portions positioned transverse said first longitudinal axis and said fourth grip portion extending oblique said first longitudinal axis.

14. A handle as set forth in claim 1 wherein said plurality of grip portions includes at least one of said grip portions positioned transverse the first longitudinal axis in a first reference plane and said second longitudinal axis positioned in a second reference plane; wherein said first and second reference planes are parallel.

15. A handle comprising:

an elongated member having first and second ends;

said elongated member including a handle portion and a shaft portion, said shaft portion extending axially and having a longitudinal axis, said handle portion including a plurality of grip portions including a rear grip portion, a front grip portion and a middle grip portion, said front grip portion positioned oblique the longitudinal axis of said shaft portion and said middle and rear grip portions positioned transverse the longitudinal axis of said shaft portion; and said front, middle and rear grip portions along with said shaft portion are positioned in a single reference plane.

16. A handle as set forth in claim 15 including a means for folding said handle.

17. A handle comprising:

an elongated member having first and second ends;

said elongated member including a handle portion and a shaft portion, said shaft portion extending axially along a second longitudinal axis, said handle portion extending axially along a first longitudinal axis, said handle portion including a plurality of grip portions at least one of said grip portions extending transverse the first longitudinal axis; and at least one of said grip portions extending oblique from said first longitudinal axis wherein said at least one of said grip portions extending transverse the first longitudinal axis and said at least one lower grip portions extending oblique said first longitudinal axis are in a common reference plane.

18. A handle as set forth in claim 17 wherein said plurality of grip portions includes a front grip portion, a middle grip portion and a rear grip portion, said middle grip portion extending transverse the first longitudinal axis and positioned between said front grip portion and said rear grip portion.

19. A handle as set forth in claim 17 wherein said plurality of grip portions includes four grip portions, three of said grip portions positioned transverse the first longitudinal axis.

20. A handle as set forth in claim 17 wherein said shaft portion includes a plurality of pivot joints.

* * * * *